US008347575B2

(12) United States Patent
Bierwirth

(10) Patent No.: US 8,347,575 B2
(45) Date of Patent: Jan. 8, 2013

(54) LIGHTWEIGHT ACOUSTICAL FLOORING UNDERLAYMENT

(75) Inventor: Lance William Bierwirth, Palatine, IL (US)

(73) Assignee: United States Gypsum Company, Chicago, IL (US)

( * ) Notice: Subject to any disclaimer, the term of this patent is extended or adjusted under 35 U.S.C. 154(b) by 0 days.

(21) Appl. No.: 12/874,367

(22) Filed: Sep. 2, 2010

(65) Prior Publication Data

US 2012/0055108 A1 Mar. 8, 2012

(51) Int. Cl.
*E04F 15/22* (2006.01)

(52) U.S. Cl. ..... 52/403.1; 52/145; 52/309.8; 52/783.1; 181/284; 428/183

(58) Field of Classification Search ..... 52/144, 52/145, 309.8, 384, 389, 403.1, 783.1, 791.1, 52/783.19, 480; 428/157, 159, 182, 183; 156/71, 77, 78, 242, 293; 181/284, 184
See application file for complete search history.

(56) References Cited

U.S. PATENT DOCUMENTS

| | | | | |
|---|---|---|---|---|
| 1,172,710 | A | 2/1916 | Howe | |
| 3,388,516 | A | 6/1968 | Thielen | |
| 3,479,779 | A * | 11/1969 | Ziegler | 52/144 |
| 4,167,598 | A * | 9/1979 | Logan et al. | 428/34.1 |
| 4,661,392 | A | 4/1987 | Kapstad | |
| 4,685,259 | A | 8/1987 | Eberhart et al. | |
| 4,945,697 | A | 8/1990 | Ott et al. | |
| 5,052,161 | A | 10/1991 | Whitacre | |
| 5,187,905 | A * | 2/1993 | Pourtau et al. | 52/144 |
| 5,619,832 | A | 4/1997 | Myrvold | |
| 5,685,124 | A * | 11/1997 | Jandl, Jr. | 52/783.11 |
| 5,867,957 | A | 2/1999 | Holtrop | |
| 6,213,252 | B1 | 4/2001 | Ducharme | |
| 6,467,118 | B2 * | 10/2002 | Dumlao et al. | 14/73 |
| 6,837,014 | B2 | 1/2005 | Virtanen | |
| 6,951,264 | B2 * | 10/2005 | Byma et al. | 181/286 |
| 7,033,666 | B2 | 4/2006 | Skaja | |
| 7,536,835 | B2 | 5/2009 | Schluter | |
| 2003/0172600 | A1 * | 9/2003 | Choi | 52/144 |
| 2004/0103602 | A1 * | 6/2004 | Geraud | 52/403.1 |
| 2005/0072083 | A1 | 4/2005 | Bauer | |

(Continued)

FOREIGN PATENT DOCUMENTS

JP 2007-332280 12/2007

OTHER PUBLICATIONS

Schluter-DITRA-Schluter-Systems, Schluter® -DITRA, pp. 1-2, http://www.schluter.com/6_1_aspx , May 21, 2010.

(Continued)

*Primary Examiner* — Brian Glessner
*Assistant Examiner* — Brian D Mattei
(74) *Attorney, Agent, or Firm* — Greer, Burns & Crain, Ltd.; Pradip Sahu; Philip T. Petti

(57) ABSTRACT

An acoustical flooring underlayment for placement between a subfloor and a finished floor, includes a mat having an upper surface, an opposite lower surface and including a plurality of corrugations creating a plurality of depressions in the upper surface. A layer of foam is applied to the upper surface and constructed and arranged to fill the depressions for creating a generally planar top surface configured for accommodating the finished floor.

15 Claims, 2 Drawing Sheets

U.S. PATENT DOCUMENTS

| | | | | |
|---|---|---|---|---|
| 2006/0054059 | A1* | 3/2006 | Dubey et al. | 106/698 |
| 2006/0156663 | A1 | 7/2006 | Mao | |
| 2006/0230699 | A1 | 10/2006 | Keene | |
| 2007/0000198 | A1 | 1/2007 | Payne et al. | |
| 2007/0289238 | A1* | 12/2007 | Payne et al. | 52/408 |
| 2008/0010930 | A1 | 1/2008 | Mao | |
| 2008/0236097 | A1 | 10/2008 | Tinianov | |
| 2009/0008819 | A1* | 1/2009 | Ozasa et al. | 264/241 |
| 2010/0077684 | A1 | 4/2010 | Socha | |

OTHER PUBLICATIONS

PCT Search Report from EP Searching Authority in co-pending International Application No. PCT/US2011/049651.

* cited by examiner

LIGHTWEIGHT ACOUSTICAL FLOORING UNDERLAYMENT

BACKGROUND

The present invention relates to flooring systems designed to reduce airborne and impact sound transmission, and more specifically relates to an improved acoustical flooring underlayment which improves acoustical isolation while avoiding cracking of the finished floor.

Conventional flooring systems include a subfloor of poured concrete or plywood. Various underlayments located between the subfloor and the finished floor (typically ceramic tile, vinyl tile or hardwood) have been used to reduce sound transmission. Sound rated or floating floor systems are known in the prior art for acoustically isolating a room beneath a floor on which impacts may occur, such as pedestrian footfalls, sports activities, dropping of toys, or scraping caused by moving furniture. Impact noise generation can generally be reduced by using thick carpeting, but where concrete, ceramic tile, sheet vinyl, or hardwood finishes are to be used, a sound rated floor may be particularly desirable. The transmission of impact noise to the area below can be reduced by resiliently supporting the floor away from the floor substructure, which typically transmits the noise into the area below. If the floor surface receiving the impact is isolated from the substructure, then the impact sound transmission will be greatly reduced. Likewise, if the ceiling below is isolated from the substructure, the impact sound will be restricted from traveling into the area below.

Sound rated floors are typically evaluated by ASTM Standard #492 and are rated as to impact insulation class (IIC). The greater the IIC rating, the less impact noise will be transmitted to the area below. Floors may also be rated as to Sound Transmission Class (STC) per ASTM E90. The greater the STC rating, the less airborne sound will be transmitted to the area below. Sound rated floors typically are specified to have an IIC rating of not less than 50 and an STC rating of not less than 50. Even though an IIC rating of 50 meets many building codes, experience has shown that in luxury condominium applications even floor-ceiling systems having an IIC of 56-57 may not be acceptable because some impact noise is still audible.

In addition to having an adequate STC and IIC rating, an acceptable sound rated floor should also have a relatively low profile. Low profile is important to maintain minimum transition height between a finished sound rated floor and adjacent areas, such as carpeted floors, which ordinarily do not need the sound rated construction. Low profile is also important for maintaining door threshold and ceiling height dimensions, restraining construction costs, and maintaining other architectural parameters.

Also, a sound rated floor must exhibit enough vertical stiffness to reduce cracking, creaking, and deflection of the finished covering. At the same time, the sound rated floor must be resilient enough to isolate the impact noise from the area to be protected below. Thus, designers of acoustic flooring must strike a balance between vibration dampening and structural integrity of the floor.

Two isolation media currently used and also approved by the Ceramic Tile Institute for sound rated tile floors are (i) 0.4 inch ENKASONIC® brand matting (nylon and carbon black spinerette extruded 630 g/sq. meter) manufactured by Colbond Inc. of Enka, N.C. and (ii) 0.25 inch Dow ETHAFOAM™ (polyethylene foam 2.7 pcf) manufactured by Dow Chemical Co., Midland Mich. While both of these systems are statically relatively soft and provide some degree of resiliency for impact insulation, the added effect of air stiffness in the 0.25 and 0.40 inch thick media makes the system very stiff dynamically and limits the amount of impact insulation. Because the systems are statically soft, they do not provide a high degree of support for the finished floor, and a relatively thick (7/16 inch) glass mesh mortar board, such as a product called Wonderboard, is used on top of the media to provide rigidity for preventing grout, tiles, and other finished flooring from cracking. Alternatively, a relatively thick (1¼ inch) reinforced mortar bed must be installed on top of the resilient mat.

Another known isolation system includes the installation of pads or mounts placed on a subfloor, wooden sleepers are then laid over the isolation pads or mounts, and a plywood deck is fastened to the sleepers to form a secondary subfloor. Often, glass fiber insulation is placed in the cavity defined between the sleepers. A poured or sheet-type underlayment material is then applied to the secondary subfloor. While acoustically effective in reducing sound transmissions, this system adds as much as 6 inches to the thickness of a floor. This thickness is undesirable in most commercial and multi-family residential buildings.

Other known acoustic flooring materials include a poured settable underlayment sold under the mark LEVELROCK™ by United States Gypsum Company of Chicago, Ill. (USG). LEVELROCK underlayment is a mixture of Plaster of Paris, Portland Cement and Crystalline Silica. LEVELROCK underlayments have been used with sound reduction mats (SRM) located between the underlayment and the subfloor. Such mats are made of polymeric material and are typically a matrix of hollow cylindrical shapes held together by a thin mesh. Another material used to dampen sound transmission is Sound Reduction Board (SRB) sold by USG of Chicago, Ill., also under the mark LEVELROCK™. SRB is a mixture of man-made vitreous fiber and minerals, including slag wool fiber, expanded Perlite, starch, cellulose, Kaolin and crystalline silica.

SUMMARY

The present lightweight acoustical flooring underlayment is designed to provide acoustic isolation to a floor system while maintaining a relatively compact, short profile, as well as having sufficient structural rigidity to prevent cracking of the finished floor. Featured in the present underlayment is an acoustically-isolating mat constructed and arranged to be placed upon the subfloor. The mat has a corrugated, truss-like cross-section and is preferably made of polymeric or rubber-like materials, although other self-supporting materials are contemplated. An upper planar surface is created by using foam to fill in top-opening corrugations or recesses defined by the mat. The foam settles within the corrugations to form the level or planar upper surface. An optional further coating of slurry for obtaining enhanced tile adhesion is contemplated for application over the foam.

An advantage of the present configuration is that acoustical continuity is disrupted between the finished floor (tile or wood), by reducing the contact area between the mat and the subfloor. An acoustical dampening effect is achieved through this discontinuity. The foam also enhances high frequency attenuation. In addition, the present configuration provides improved strength against compressive forces exerted on the aesthetic floor coating.

More specifically, an acoustical flooring underlayment is provided for placement between a subfloor and a finished floor, and includes a mat having an upper surface, an opposite lower surface and including a plurality of corrugations creating a plurality of depressions in the upper surface. A layer of foam is applied to the upper surface and constructed and arranged to fill the depressions for creating a generally planar top surface configured for accommodating the finished floor.

In another embodiment, a floor system is provided, including a subfloor, a poured settable underlayment placed upon the subfloor, a mat placed upon the settable underlayment, the mat having a plurality of corrugations defining an upper surface and a lower surface. A layer of foam is placed upon the upper surface of the mat to fill corrugations in the upper surface for forming a planar top surface. A layer of adhesive enhancing composition is placed upon the top surface, and a finished floor is disposed upon the adhesive enhancing composition.

DETAILED DESCRIPTION OF THE INVENTION

Figure 1:
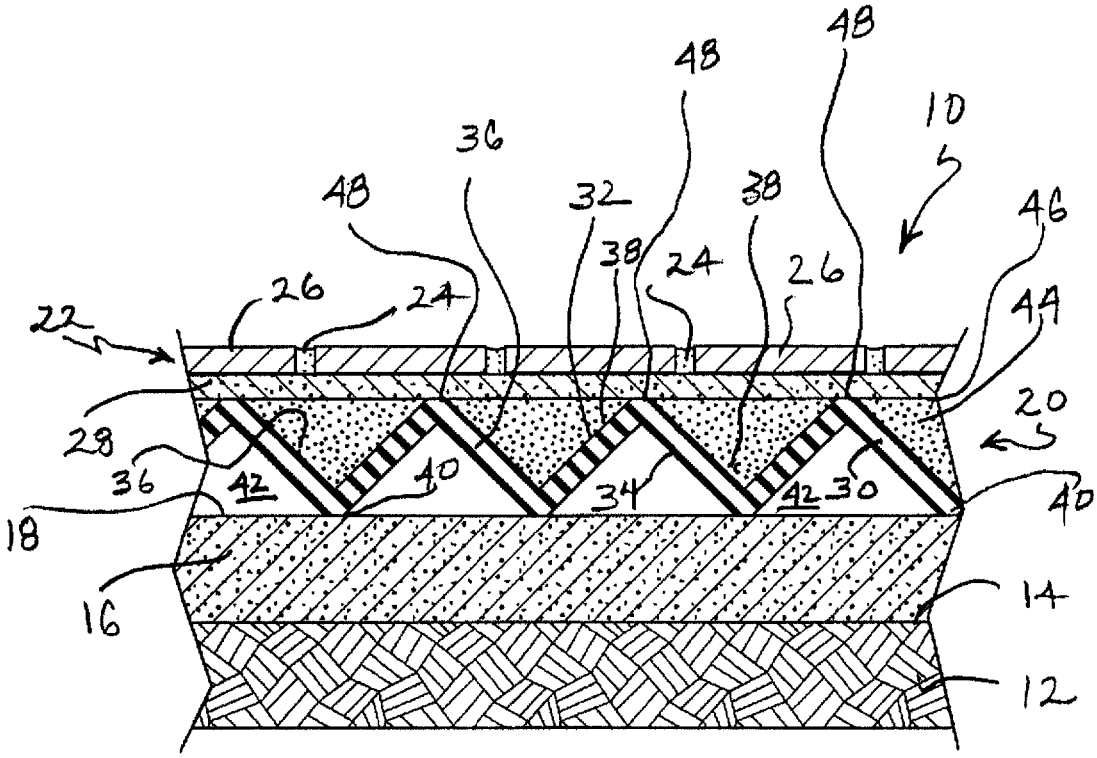
FIG. 1 is a fragmentary vertical cross section of a floor system incorporating the present acoustical underlayment.

Referring now to FIG. 1, the present flooring system is generally designated 10, and is used in a construction having a subfloor 12, shown schematically and typically being poured concrete or at least one layer of plywood as is known in the art. While only the above two alternatives are disclosed, it is contemplated that any conventional subfloor material will be suitable for use with the present flooring system 10. As is known in the art, the subfloor is supported by joists (not shown) typically made of wood, steel or concrete.

Upon an upper surface 14 of the subfloor 12 is preferably disposed an underlayment 16. In the preferred embodiment, the underlayment 16 is a poured material, specifically USG LEVELROCK™ floor underlayment 2500, having a composition of at least 85% by weight Plaster of Paris (CaSO4 ½ H2O), less than 10% by weight Portland Cement and less than 5% by weight crystalline silica. Upon setting of the underlayment 16, a smooth, level upper surface 18 is created. It is also contemplated that the underlayment 16 is optionally sheets of Sound Reduction Board (SRB) having a composition of at least 30% by weight slag wool fiber; no more than 40% by weight expanded Perlite, less than 15% by weight starch, at least 5% by weight cellulose and, less than 10% by weight Kaolin and less than 5% by weight crystalline silica.

The ingredients are mixed, formed into slurry, formed into sheets and dried. A suitable type of such SRB is sold by USG under the LEVELROCK™ SRB brand, however equivalent types of SRB are commercially available. The SRB is preferably laid upon the subfloor 12 without adhesive or fasteners. Besides these products, other underlayments are contemplated, including but not limited to FIBEROCK™ or DUROCK™ underlayments sold by USG.

Next, upon the upper surface 18 of the poured underlayment 16 is disposed the present acoustical flooring underlayment, generally designated 20, which is sandwiched between the underlayment 16 and a finished floor 22 which is typically ceramic tile, vinyl tile, hardwood or other hard materials other than carpeting. As depicted, the finished floor 22 is ceramic tile, with grout 24 separating the tiles 26. Below the tiles 26 is preferably disposed a crack resistant adhesive layer 28 such as mortar, mastic or chemical adhesive that typically secures the finished floor 22 to the underlayment 14, but in the present application secures the finished floor to the acoustical flooring underlayment 20.

Figure 2:
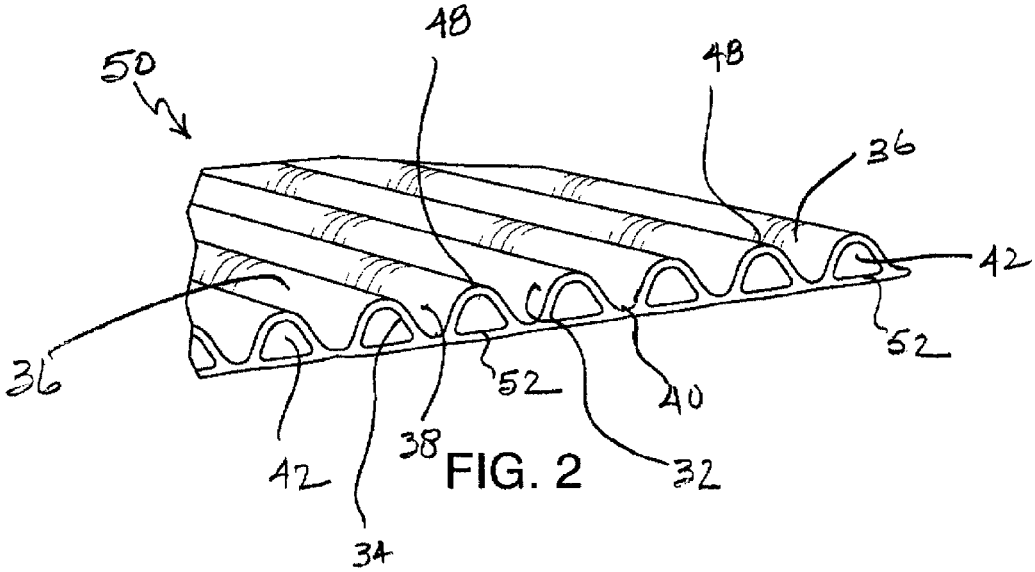
FIG. 2 is a fragmentary top perspective view of an embodiment of the present mat.

Returning now to the present acoustical flooring underlayment 20, it is preferably located between the underlayment 16 and the finished floor 22, thus being closer to the finished floor than prior art products, to enhance the acoustical isolation near the finished floor (and the source of the unwanted noise) without sacrificing structural properties that resist cracking of the finished floor. In the present underlayment 20, there are two main components. The first is a mat 30 having an upper surface 32, an opposite lower surface 34 and shaped into a plurality of corrugations 36 creating a plurality of depressions 38 in the upper surface. As seen in FIG. 2, the corrugations 36 define open-topped, narrow-bottomed depressions 38, being generally "V"-shaped or triangular in cross-section as seen in FIG. 1.

Opposite the upper surface 32, the lower surface 34 has a plurality of contact points 40 for contacting a substrate, here the upper surface 18 of the underlayment 16. The contact points 40 are laterally spaced apart, defining voids 42 between the corrugations 36. It will be seen that the lower surface 34 of the mat 30 forms a plurality of triangular trusses in cross-section and the plurality of contact points 40 are formed by common lower edges of adjacent corrugations.

In the preferred embodiment, the mat 30 is made of polymeric, rubber-like material that is sufficiently rigid to be self supporting, and such that the corrugations 36 resist vertical compression and/or shock loading. The specific material for the mat 30 is not critical besides the above structural considerations are met, and even vegetable starch is contemplated for environmentally-friendly designs.

Upon the upper surface 32, a layer of foam 44 is applied and is constructed and arranged to fill the depressions 38 for creating a generally planar top surface 46 configured for accommodating the finished floor 22. The foam 44 is preferably polyurethane foam and is sprayed and screed or troweled so that the foam forms the planar top surface 46, incorporating and being coplanar with upper points 48 of the corrugations 36. Upon drying or setting or otherwise after application, the foam 44 has many air voids or spaces which disrupt sound transmission. Sprayed-in-place foam as described above is considered superior in acoustical properties to premade and cut-to-fit foam. It is contemplated that the present acoustical underlayment 20 is provided as a unit with the foam 44 applied and leveled upon the mat 30, resulting in a unitary product. However, on-site fabrication is also contemplated.

Also, upon setting of the foam 44, the underlayment 20 is constructed so that the truss-like corrugations 36 of the mat 30 provide sufficient structural rigidity to resist cracking of the finished floor 22, while the foam disrupts the transmission of sound.

Referring now to FIG. 2, an alternative embodiment to the mat 30 is depicted and generally designated 50, in which shared components with the mat 30 are designated with identical reference numbers. It is contemplated that the mat 50 also is provided with a layer of foam 44 as described in relation to the mat 30, however the foam has not been depicted to more clearly show other aspects of the mat. A feature of the mat 50 is that the corrugations 36, also referred to as flutes, are joined along the bottom contact points 40 by a liner or base layer 52 preferably integrally formed with the mat. This construction provides a lower layer of sound absorbing material below the voids 42, enclosed the voids and provides additional structural support to the truss-like corrugations 36.

Figure 3:
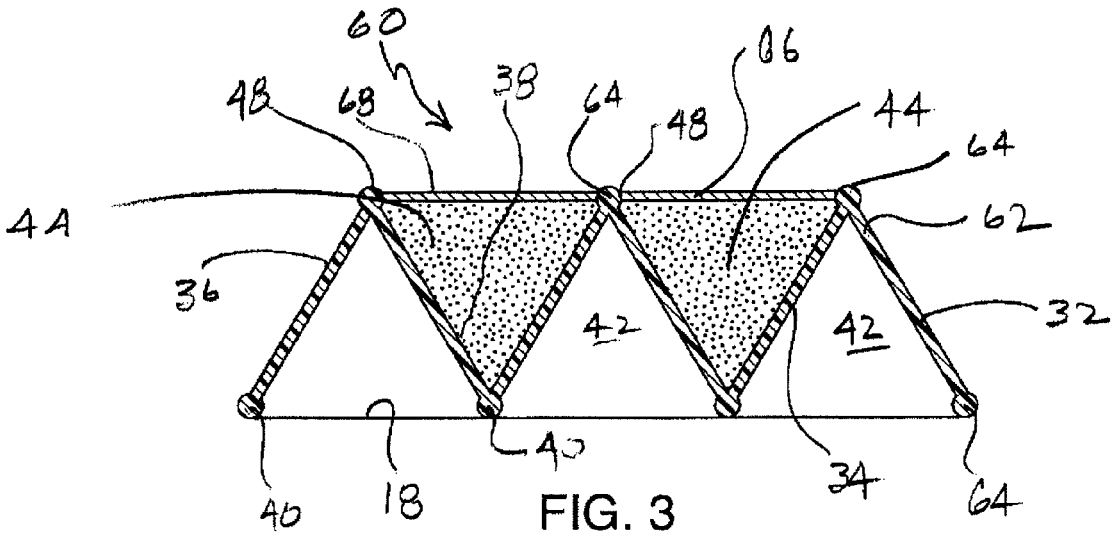
FIG. 3 is a fragmentary vertical section of another embodiment of the present acoustical underlayment.

Referring now to FIG. 3, still another embodiment of the present acoustic underlayment 20 is generally designated 60, and components shared with the underlayment 20 are designated with identical reference numbers. Distinguishing features of the underlayment 60 is that the mat 62 is provided with nodes 64 at the respectively lower and upper points 40 and 48 for additional structural support. While the shape of the nodes 64 is not critical, in the depicted embodiment the nodes are generally circular in cross-section. It is contemplated that the nodes 64 are integrally formed with the remainder of the mat 62.

Upper surface depressions 38 of the mat 62 are filled with foam 44 as in the underlayment 20. However, the foam 44 does not reach tops of the nodes 64. A supplemental layer of adhesive enhancing composition 66 is disposed upon the foam 44 to create the desired level upper surface 68 that incorporates the nodes 64. The layer 66 is intended to enhance tile adhesion, and is preferably a fly ash/polymer slurry, or a solvent-free, advanced polymer similar to products used with Durock™ Tile Membrane sold by USG.

Thus, it will be seen that the present acoustical isolation underlayment system addresses the needs identified above, and provides a low profile system for disrupting acoustical transmissions between floors. Also, the structural integrity of the floor is maintained while also providing shock absorbing characteristics.

While particular embodiments of the present lightweight acoustical flooring underlayment have been described herein, it will be appreciated by those skilled in the art that changes and modifications may be made thereto without departing from the invention in its broader aspects and as set forth in the following claims.

The invention claimed is:

1. An acoustical flooring underlayment for placement between a subfloor and a finished floor, comprising:

a mat constructed as a single piece having an upper surface, an opposite lower surface and including a plurality of self-supporting corrugations creating a plurality of depressions in said upper surface, said mat further including thickened nodes at points of said corrugations; and a layer of settable foam applied to said upper surface, and constructed and arranged to generally fill said depressions for creating a generally planar top surface configured for accommodating the finished floor such that tops of said nodes project above said top surface;

wherein said mat forms a plurality of triangular trusses in vertical cross-section, and said lower surface includes a plurality of lower contact points located at the lower edges of the corrugations for contacting a substrate, said lower contact points being separated by voids defined by the corrugations to reduce the contact area between said mat and the subfloor, thereby disrupting acoustical continuity between the subfloor and the finished floor.

2. The underlayment of claim 1 further including a supplemental layer of adhesive enhancing composition.

3. The underlayment of claim 2 wherein said adhesive enhancing composition is a fly ash/polymer slurry.

4. The underlayment of claim 2 wherein said supplemental layer is coplanar with upper points of said corrugations.

5. The underlayment of claim 1 further comprising a supplemental layer of adhesive enhancing composition disposed upon said foam to create an upper level surface that incorporates said nodes projecting above said top surface.

6. The underlayment of claim 1 wherein said nodes are generally circular in cross-section.

7. The underlayment of claim 1 wherein said foam is polyurethane and is sprayed upon said upper surface and then troweled or screed to form said planar top surface.

8. The underlayment of claim 1 wherein said mat is made of a polymeric material.

9. The underlayment of claim 1 wherein said mat is made of vegetable starch.

10. The underlayment of claim 1 wherein said corrugations are joined along the bottom contact points by a base layer integrally formed with the mat.

11. The underlayment of claim 1 wherein said upper surface includes a plurality of upper contact points for contacting a substrate, and said corrugations are formed by linear segments connecting said upper contact points and said lower contact points.

12. A floor system, comprising:

a subfloor;

a poured settable underlayment placed upon said subfloor;

a mat constructed as a single piece placed upon said settable underlayment, said mat having a plurality of self-supporting corrugations with thickened, radiused nodes at points of said corrugations and defining an upper surface and a lower surface, the lower surface includes a plurality of lower contact points located at the lower edges of the corrugations directly contacting the underlayment;

a layer of foam placed upon said upper surface of said mat to generally fill said corrugations in said upper surface for forming a generally planar top surface;

a layer of adhesive enhancing composition disposed upon said top surface and incorporating said nodes; and a finished floor disposed upon said adhesive enhancing composition, wherein only said nodes on said lower surface make contact with said underlayment.

13. The floor system of claim 12 wherein said corrugations define a plurality of generally "V"-shaped depressions in said upper surface for receiving said layer of foam.

14. The floor system of claim 12 wherein said nodes are generally circular in cross-section.

15. The floor system of claim 12 wherein said adhesive enhancing composition is a fly ash/polymer slurry.

* * * * *